US006354060B1

(12) United States Patent
Plüschow et al.

(10) Patent No.: US 6,354,060 B1
(45) Date of Patent: Mar. 12, 2002

(54) PACKAGING MACHINE

(75) Inventors: Dieter Plüschow; Dirk Witte, both of Stutensee (DE)

(73) Assignee: IWK Verpackungstechnik GmbH, Stutensee (DE)

( * ) Notice: Subject to any disclaimer, the term of this patent is extended or adjusted under 35 U.S.C. 154(b) by 0 days.

(21) Appl. No.: 09/551,849

(22) Filed: Apr. 18, 2000

(30) Foreign Application Priority Data

Apr. 23, 1999 (DE) ..... 199 18 527

(51) Int. Cl.[7] ..... B65B 35/54

(52) U.S. Cl. ..... 53/157; 53/156; 53/252; 53/67; 53/505

(58) Field of Search ..... 53/157, 156, 252, 53/50, 494, 505, 67

(56) References Cited

U.S. PATENT DOCUMENTS 3,523,400 A * 8/1970 Daily ..... 53/157
3,982,382 A 9/1976 Vogel
4,059,264 A * 11/1977 Vogel ..... 53/157
5,406,772 A * 4/1995 Dinius ..... 53/64
5,476,035 A * 12/1995 Florindez ..... 53/67
5,481,848 A * 1/1996 Tagliaferri et al. ..... 53/157
5,660,022 A * 8/1997 Lade et al. ..... 53/252

FOREIGN PATENT DOCUMENTS

DE 30 40 866 6/1982
DE 28 46 607 11/1989

* cited by examiner

*Primary Examiner*—Peter Vo
*Assistant Examiner*—Sameh Tawfik
(74) *Attorney, Agent, or Firm*—Paul Vincent

(57) ABSTRACT

A packaging machine comprises a transfer device for inserting a product into a package, and a circulating leaflet transport device comprising a plurality of tong-like holders, each receiving one leaflet and by means of which the leaflet can be disposed between the product and the package in the region of the transfer device for insertion, together with the product, into the package. A stop is disposed in the region of the transfer device and in the transport path of the tong-like holder to open the holder for releasing the leaflet. If there is no package in the transfer station, the stop can be removed from the transport path of the tong-like holders into a non-operating position, for passage of a holder without opening thereof.

16 Claims, 3 Drawing Sheets

PACKAGING MACHINE

This application claims Paris Convention priority of DE 199 18 527 filed Apr. 23, 1999 the complete disclosure of which is hereby incorporated by reference.

BACKGROUND OF THE INVENTION

The invention concerns a packaging machine comprising a transfer device for inserting a product into a package, in particular, a folding box, and with a circulating leaflet-transporting device comprising a plurality of tong-like holders, each receiving one leaflet and which can dispose the leaflet between the product and the package in the region of the transfer device for insertion thereof, together with the product, into the package, wherein, in the region of the transfer device, a stop is disposed in the transport path of the tong-like holder for opening the holder to release the leaflet.

When packaging products using a transfer device in a packaging machine, the motions of a first circulating transport device for the package, e.g. a so-called folding box chain, is usually synchronized with that of a second circulating transport device for the products, e.g. a so-called product chain, in such a manner that the product can be inserted at a side of the folding box, transverse to the direction of motion of the chains. With certain products, e.g. medication, a leaflet or package insert must be added to the package. Towards this end, a further circulating transport device is provided supporting a plurality of tong-like holders, each of which receives and clamps a leaflet. A leaflet to be inserted into the package is moved in the transport device and disposed between the product and the folding box and is pushed by the product, during lateral inserting motion thereof, into the folding box. As soon as the product abuts against the leaflet, the tong-like holder must be opened to release the leaflet. Towards this end, the tong-like holder abuts, during its transport motion, against a stationary stop wedge disposed proximate to the transfer device. The stop wedge interacts with the holder upon abutment thereof to open the tong arms and release the leaflet.

Packaging machines are sometimes subject to minor malfunctions which can cause temporary, discontinuous delivery of folding boxes to the folding box chain, wherein one or several sections of the folding box chain are not occupied by folding boxes. This absence of a folding box is recognized by a sensor mechanism to stop insertion of the product. When abutting against the stop wedge, the tong-like holder opens to release the leaflet. The leaflet should then fall out through the bottom of the packaging machine. However, it has turned out that the released leaflet can inadvertently remain in the transfer station or can move in an uncontrolled manner through the packaging machine leading to operational disturbances thereof and possibly to temporary stoppage which must usually be dealt with manually and which is therefore time consuming and expensive.

It is the underlying purpose of the invention to provide a packaging machine of the mentioned type which reliably avoids uncontrolled motion of a leaflet.

SUMMARY OF THE INVENTION

This object is achieved in accordance with the invention in a packaging machine of the above-mentioned kind in that the stop can be removed from the transport path of the tong-like holder into a non-operating position. In this manner, the invention causes the tong-like holder to open and release the leaflet only if a folding box is actually present in the folding box chain. If there is no folding box, the stop is moved out of the transport path of the tong-like holder such that the tong-like holder and leaflet pass by the stop without opening. The stop then returns to its operating position for opening the next tong-like holder when a folding box is present in the folding box chain. In this fashion, the leaflet is released only if it can be inserted into a folding box to prevent uncontrolled release of the leaflets within the transfer device.

If there is no folding box in the folding box chain proximate the transfer device, the leaflet is transported further in the tong-like holder and removed in a defined manner therefrom at a downstream station, preferably disposed at the lower side of the packaging machine, i.e. in the lower transport region of the circulating leaflet transport device.

In a further development of the invention, a sensor means is provided for detecting the presence of a package at the transfer device and for generating a control signal to bring the stop into the non-operating position when no package is present. The sensor means may be an optical or mechanical sensor of conventional design which can reliably detect whether or not a folding box is present in the predetermined section of the folding box chain. In dependence upon said detection, the stop either remains in its operating position within the transport path to open the tong-like holders or it is laterally removed from the transport path into the non-operating position.

In a preferred embodiment of the invention, the stop is biased into its non-operating position by a spring, such that activation of a controllable actuating device is required to move the stop, in opposition to the spring bias, into the operating position and for keeping it there as long as the presence of a folding box is determined by the sensor device. The actuating device is preferably an adjustable pneumatic or hydraulic cylinder.

The stop can be displaced transverse to the transport direction of the chains. In a particularly simple and robust embodiment, the stop is borne for pivoting.

In order to be able to use and adapt the packaging machine to products of different sizes, the stop is preferably adjustable along the transport path of the tong-like holders. This can, in particular, be effected by disposing the stop, together with the spring generating the spring bias and the actuating device, on a displaceably supported slide which can be adjusted, preferably via a chain or a toothed belt in cooperation with an adjustment spindle.

In a preferred manner, the leaflets which remain in an unopened tong-like holder and which are transported through the transport device are removed at a downstream station. Towards this end, a further, in particular stationary remote stop, i.e. disposed downstream of the transfer device, is provided for opening the tong-like holder. If the holder transports a leaflet, the leaflet is removed at this point and transported via a further transport device, e.g. a belt or roller conveyor, away from the transport path of the circulating chains and fed to a container.

The tong-like holder must be kept open by the stop for a sufficiently long period of time to guarantee safe removal of the leaflet from the tong-like holder during insertion of the product. With rapidly working packaging machines, the stop must therefore generally have a length in the transport direction of the chains which is greater than the distance between two adjacent tong-like holders. If such a stop is brought into its non-operating position, several tong-like holders could inadvertently remain closed. In a further development of the invention, this is prevented in that the stop comprises a plurality of stop parts disposed one after the other in the transport direction of the tong-like holders which can be adjusted, independently of one another, between the operating and non-operating positions. The length of each stop part, in the transport direction of the tong-like holders, is therefore less than the spacing between adjacent holders to thereby guarantee that each stop part can return to its operating position as soon as a holder which is to remain closed has passed by and before the next holder reaches that stop part. Corresponding control of the individual stop parts is achieved by sensor means which detect the current position of the holder and which act on the independent actuating means associated with each stop part.

Further details and features of the invention can be extracted from the following description of an embodiment with reference to the drawings.

DESCRIPTION OF THE PREFERRED EMBODIMENT

Figure 1:
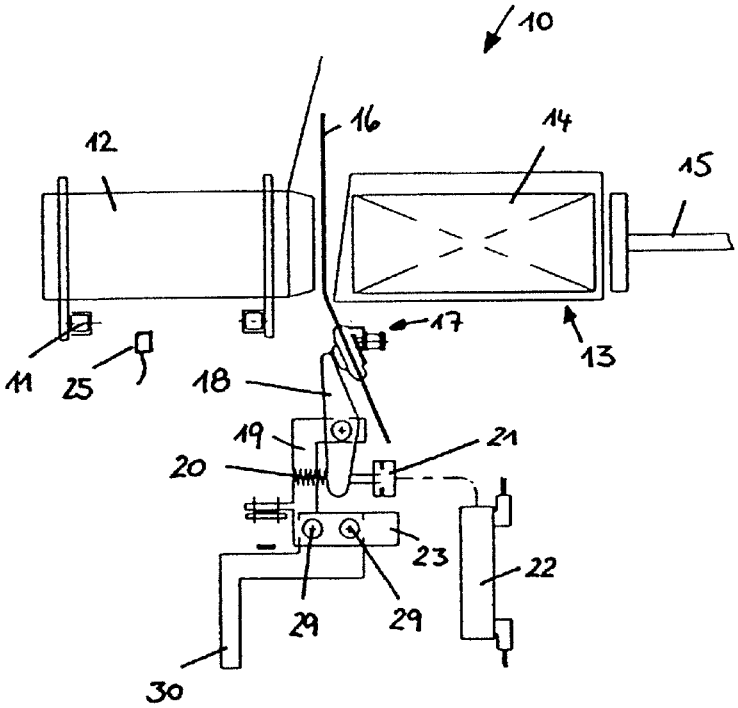
FIG. 1 shows a cross-section through a packaging machine in the region of a transfer device immediately prior to insertion of the product.
Figure 2:
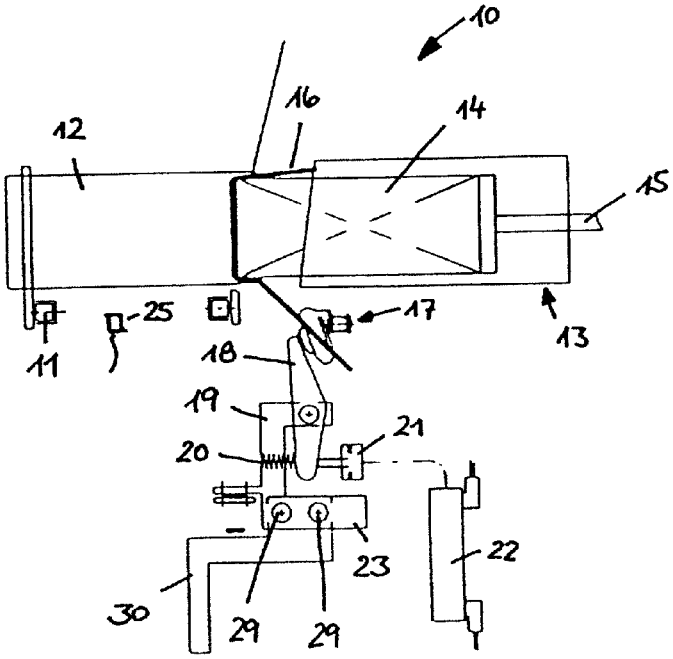
FIG. 2 shows an illustration corresponding to FIG. 1 during insertion of the product.
Figure 3:
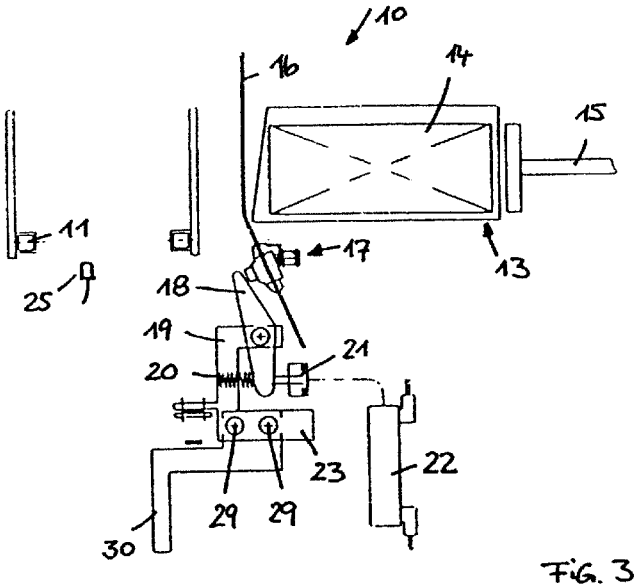
FIG. 3 shows an illustration corresponding to FIG. 1 without folding box.

FIGS. 1 through 3 show a section of a packaging machine 10 comprising a folding box chain 11, extending perpendicularly to the plane of the drawing, for receiving folding boxes 12, and a product chain 13, extending parallel thereto, for receiving products 14 to be packaged. The motions of the folding box chain 11 and the product chain 13 are synchronized such that the product 14 can be inserted into the open folding box transverse to the direction of movement of the chains by means of a pushing device 15 of a transfer station.

Figure 4:
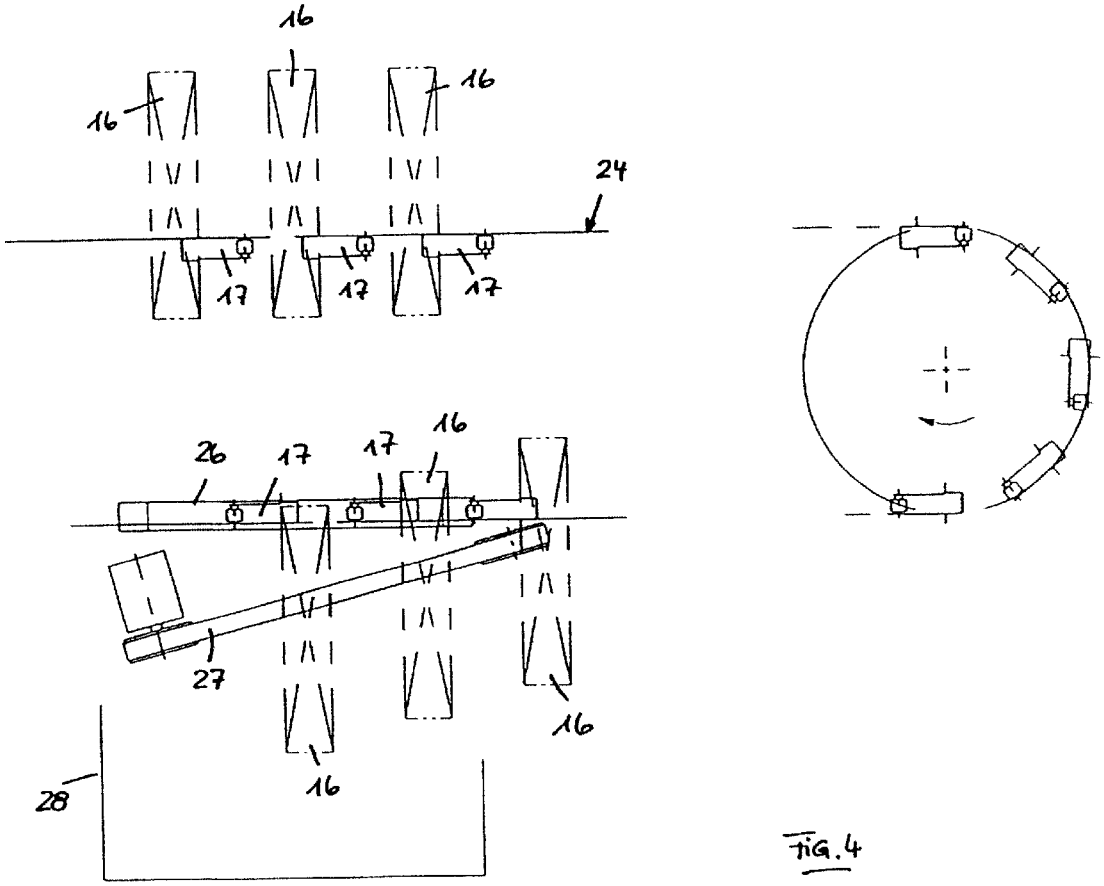
FIG. 4 shows a side view of the circulating leaflet transport device.

A circulating leaflet transport device 24 (see FIG. 4) is disposed below the two chains 11 and 13, essentially parallel thereto, and carries a plurality of tong-like holders 17 at regular intervals, between the jaws or tongs of which a leaflet can be clamped in upright orientation. The leaflet 16 is disposed between the folding box chain 11 and the product chain 13 in the region of the transfer station and is carried along by the product 14 and pushed into the folding box 12 when the product 14 is inserted laterally into the folding box 12 (see FIG. 2)

The holder 17 clamping the leaflet 16 must be opened for insertion of the leaflet 16 into the folding box 12. Towards this end, the transfer device comprises a stop wedge 18 which is disposed, in its operating position shown in FIG. 1, in the transport path of the tong-like holder 17 to abut against the stop wedge 18 and spread the jaws of the tong-like holder 17 to release the leaflet 16.

The stop wedge 18 is pivotably disposed on a yoke-shaped shackle 19. The shackle 19 is mounted on a slide 23 which can be displaced along two rails 29, mounted on a stationary construction part 30, in the transport direction of the chains, i.e. perpendicular to the plane of the drawing. A spring 20 acts between the pivotable stop wedge 18 and the shackle 19 and urges the stop wedge 18 into a pivoted, non-operating position. A pneumatic piston cylinder unit 21 is disposed on the side of the stop wedge 18 opposite to the spring 20, which can be actuated with compressed air via a pneumatic valve 22 such that its piston drives the stop wedge 18, in opposition to the spring 20 force, into the vertical operating position.

The folding box chain 11 has an associated sensor 25 which recognizes whether or not the section of the folding box chain entering the transfer device contains a folding box 12. If the presence of a folding box 12 is detected, the stop wedge 18 remains in the extended operating position maintained by the extended piston of the pneumatic piston cylinder unit 21. This operating position ensures that the tong-like holder 17 clamping the associated leaflet 16 abuts against the stop wedge 18 and is thereby opened such that the leaflet 16 can be inserted into the folding box by means of and along with the product 14 (see FIGS. 1 and 2).

If the sensor 25 detects the absence of a folding box 12 in the folding box chain 11 for the next product 14 to be inserted, the pneumatic valve 22 is opened to return the piston of the pneumatic piston cylinder unit 21 and move the stop wedge 18 into its pivoted non-operating position in response to the force of spring 20. In this position, the holder 17 of the associated leaflet 16 does not abut against the stop wedge 18 and is therefore not opened. At the same time, insertion of the product 14 is stopped. This state is shown in FIG. 3. The leaflet 16 remains clamped in the tong-like holder 17 and is guided therewith through the transfer device to a downstream removal station disposed in the lower section of the leaflet transport device 24 (see FIG. 4) and comprising a stationary stop 26 for opening the tong-like holder. The leaflet released in this manner is transported to a container 28 (shown in FIG. 4) provided therefor via a transport device 27.

As soon as the sensor 25 detects a folding box in the folding box chain 11, the pneumatic piston cylinder unit 21 is activated to extend the piston and move the stop wedge 18 into its operating position in opposition to the force of spring 20 (shown in FIG. 1) such that the next tong-like holder 17 abuts against the stop wedge 18 and is opened.

Figure 5:
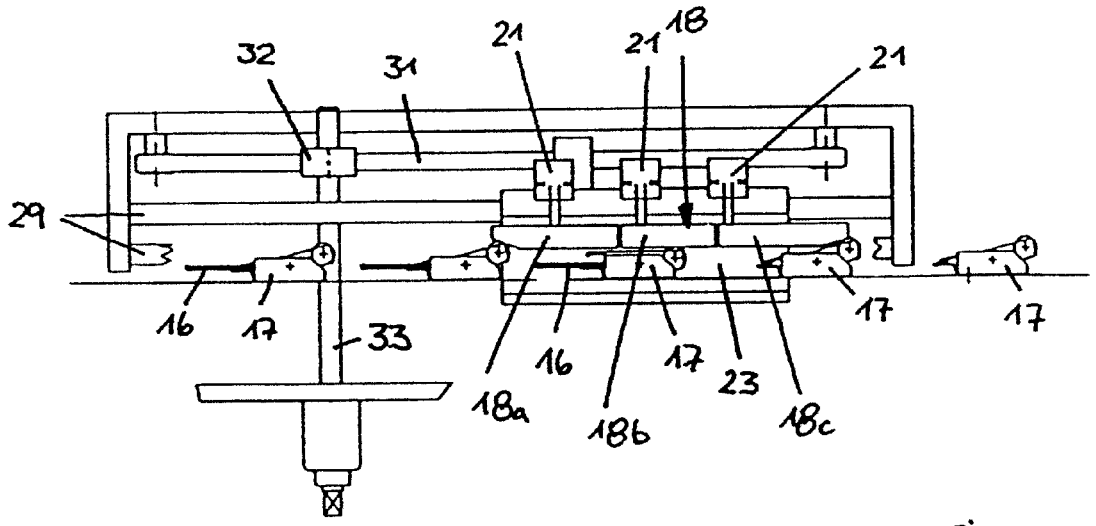
FIG. 5 shows a view of an alternative embodiment of the stop in its operating position.

The adjustment motion of the slide 23 along the rails 29 is effected by a toothed belt 31 which engages the slide 23 as well as a driven toothed wheel 32 mounted to a driven shaft 33 (FIG. 5). The slide and therefore the stop wedge 18 can thereby be adjusted in the travel direction of the leaflet transport device to adapt to the product length.

Figure 6:
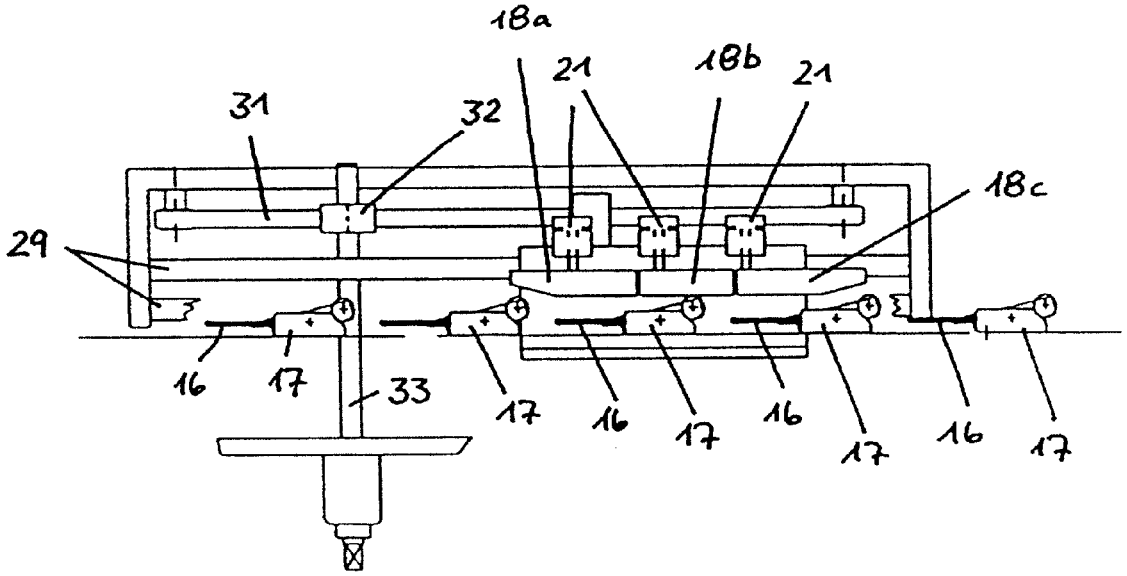
FIG. 6 shows the stop according to FIG. 5 in the non-operating position.

FIGS. 5 and 6 show an embodiment of the stop wedge 18 consisting of several parts. The stop wedge 18 thereby comprises three stop parts 18*a,* 18*b* and 18*c,* disposed one after another in the transport direction of the tong-like holders 17, each of which is pivotable and biased by means of a spring (not shown) into its non-operating position in the manner described above. Each stop part 18*a,* 18*b* and 18*c* has an associated pneumatic piston cylinder unit 21 which moves the associated stop part into the operating position in opposition to the force of the spring. The stop parts have lengths, measured in the transport direction, which are shorter than the spacing between adjacent tong-like holders. In FIG. 5, all three stop parts 18*a,* 18*b* and 18*c* are in their operating positions, i.e. disposed in the transport path of the tong-like holders 17 to abut with and open same. The two tong-like holders 17 shown at the left in FIG. 5 each bear a leaflet 16 which is clamped between the spring-loaded jaws of the holder 17. The holders 17 move to the right on the circulating leaflet transport device 24 of FIG. 5. A stop part of a holder thereby abuts against the stop wedge 18 to open the holder 17 (shown for the central holder of FIG. 5) to remove the leaflet 16. After passing the stop wedge 18, the holder returns to its clamping position under action of the internal spring force, with the leaflet having been removed, as shown in the two right-hand sided holders of FIG. 5.

In accordance with FIG. 6, all three stop parts 18*a,* 18*b* and 18*c* are displaced to the side of the transport path of the holders 17 into their non-operating positions, such that the holders pass the stop wedge 18 without being opened thereby. Since each stop part 18*a,* 18*b* and 18*c* has its own pneumatic piston cylinder unit 21, the stop parts can be moved from their operating positions into their non-operating positions individually and one after another, such that one individual holder can pass the stop wedge 18 without being opened, with a subsequent holder being opened by a stop part 18*a* which has already returned to its operating position during a time when the next stop part 18*b* is still in its non-operating position.

We claim:

1. A transfer device in a packaging machine for insertion of a product and a leaflet into a package, the packaging machine having a frame supporting a circulating folding box chain for receiving packages, the frame also supporting a circulating product chain for receiving products to be packaged, the product chain moving parallel to and synchronously with the folding box chain, and with a pushing device, mounted to the frame, for inserting each product into an open package in a direction transverse to motion of the product chain and the folding box chain, the transfer device comprising:

a circulating leaflet transport device borne on the frame and having a plurality of tong holders, each tong holder receiving and carrying one leaflet to dispose each leaflet between a product and a package for insertion of each leaflet, together with the product, into the package; and a stop mounted to the frame, said stop having an operating position in which it is disposed in a transport path of said tong holders to open said holders for releasing the leaflets; and means mounted to said frame and cooperating with said stop, for withdrawing said stop from said transport path into a non-operating position, wherein, in said non-operating position, said tong holders travel past said stop without being opened thereby.

2. The transfer device of claim 1, characterized by a sensor device for detecting a presence of the package in the transfer device and for transmitting a control signal to said withdrawal means to move said stop into said non-operating position when no package is present.

3. The transfer device of claim 1, wherein said withdrawal means comprise means for spring-biasing said stop into said non-operating position and a controllable actuating means for urging said stop into an operating position in opposition to said spring-biasing.

4. The transfer device of claim 1, wherein said stop is borne for pivoting.

5. The transfer device of claim 1, further comprising means for adjusting said stop along said transport path of said tong holders.

6. The transfer device of claim 5, wherein said adjusting means comprise a displaceably supported slide to which said stop is mounted.

7. The transfer device of claim 1, wherein said stop comprises several stop parts, disposed one after another in a transport direction of said tong holders, and said withdrawal means comprises several withdrawal means parts, cooperating with said several stop parts for individual adjustment of each stop part, independent of other stop parts, between an operating position and said non-operating position.

8. A packaging machine for insertion of a product and a leaflet into a package, the machine comprising:

a frame;

a circulating folding box chain, mounted to said frame, for receiving packages;

a circulating product chain, mounted to said frame for receiving products to be packaged, said product chain moving parallel to and synchronously with said folding box chain;

a pushing device mounted to said frame for inserting each product into an open package in a direction transverse to motion of said product chain and said folding box chain;

a circulating leaflet transport device borne on the frame and having a plurality of tong holders, each tong holder receiving and carrying one leaflet to dispose each leaflet between the product and the package for insertion of each leaflet, together with the product, into the package; and a stop mounted to the frame, said stop having an operating position in which it is disposed in a transport path of said tong holders to open said holders for releasing the leaflet; and means mounted to said frame and cooperating with said stop, for withdrawing said stop from said transport path into a non-operating position, wherein, in said non-operating position, said tong holders travel past said stop without being opened thereby.

9. The packaging machine of claim 8, characterized by a sensor device for detecting a presence of the package at a transfer location and for transmitting a control signal to said withdrawal means to move said stop into said non-operating position when no package is present.

10. The packaging machine of claim 8, wherein said withdrawal means comprise means for spring-biasing said stop into said non-operating position and a controllable actuating means for urging said stop into an operating position in opposition to said spring-biasing.

11. The packaging machine of claim 8, wherein said stop is borne for pivoting.

12. The packaging machine of claim 8, further comprising means for adjusting said stop along said transport path of said tong holders.

13. The packaging machine of claim 12, wherein said adjusting means comprise a displaceably supported slide to which said stop is mounted.

14. The packaging machine of claim 8, further comprising a second stop, disposed downstream of said stop, for opening said tong holders.

15. The packaging machine of claim 14, further comprising a second transport device cooperating with said second stop for transporting away the leaflet.

16. The packaging machine of claim 8, wherein said stop comprises several stop parts, disposed one after another in a transport direction of said tong holders, and said withdrawal means comprises several withdrawal means parts, cooperating with said several stop parts for individual adjustment of each stop part, independent of other stop parts, between said operating position and said non-operating position.

* * * * *